United States Patent [19]

Keeling

[11] 4,341,490

[45] Jul. 27, 1982

[54] SELF-SUSTAINING LAND IRRIGATING AND HYDROELECTRIC POWER GENERATING SYSTEM

[76] Inventor: Walter W. Keeling, Roanoke and Market Sts., Amsterdam, Va. 24175

[21] Appl. No.: 197,027

[22] Filed: Oct. 15, 1980

[51] Int. Cl.[3] ..... E02B 13/00

[52] U.S. Cl. ..... 405/36; 405/37; 405/52

[58] Field of Search ..... 405/36–49, 405/210, 75–78, 52–59

[56] References Cited

U.S. PATENT DOCUMENTS

| | | | |
|---|---|---|---|
| 585,103 | 6/1897 | Jamison | 405/39 |
| 1,042,501 | 10/1912 | Thompson | 405/39 |
| 1,173,534 | 2/1916 | Ryan | 405/39 X |
| 1,863,728 | 6/1932 | Porter | 405/75 |
| 3,408,818 | 11/1968 | Hemphill | 405/37 |
| 3,797,253 | 3/1974 | Rodieck | 405/37 |
| 4,014,173 | 3/1977 | Keeling | 405/78 |

*Primary Examiner*—Dennis L. Taylor

*Attorney, Agent, or Firm*—D. Paul Weaver

[57] ABSTRACT

A practical, economical and self-sustaining irrigation system for extensive arid regions utilizes a network of hydraulic ram fitted gravity-feed water tanks connected in series. Ram exhaust water is fed into irrigation pipes or ditches along the system. Ram elevated water in the tanks of the system is gravity fed from each tank to the next downstream ram. The first ram in the system is fed from a natural water source or dam. A complete system may include several natural or dammed water sources each feeding a downstream network of rams and tanks. Electrical power can also be generated in the system at least at the initial and secondary sources of water.

10 Claims, 4 Drawing Figures

FIG.1
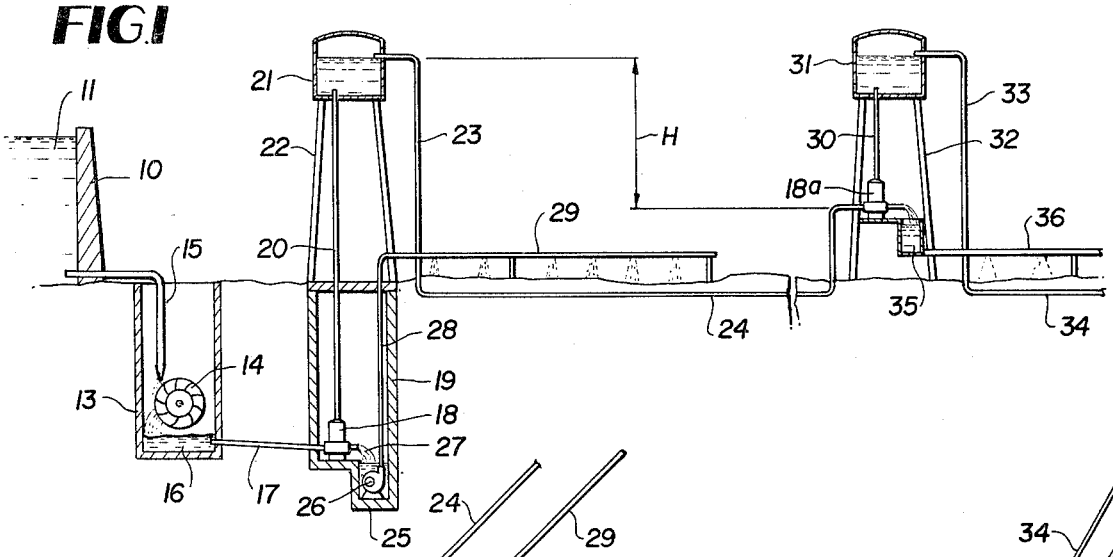
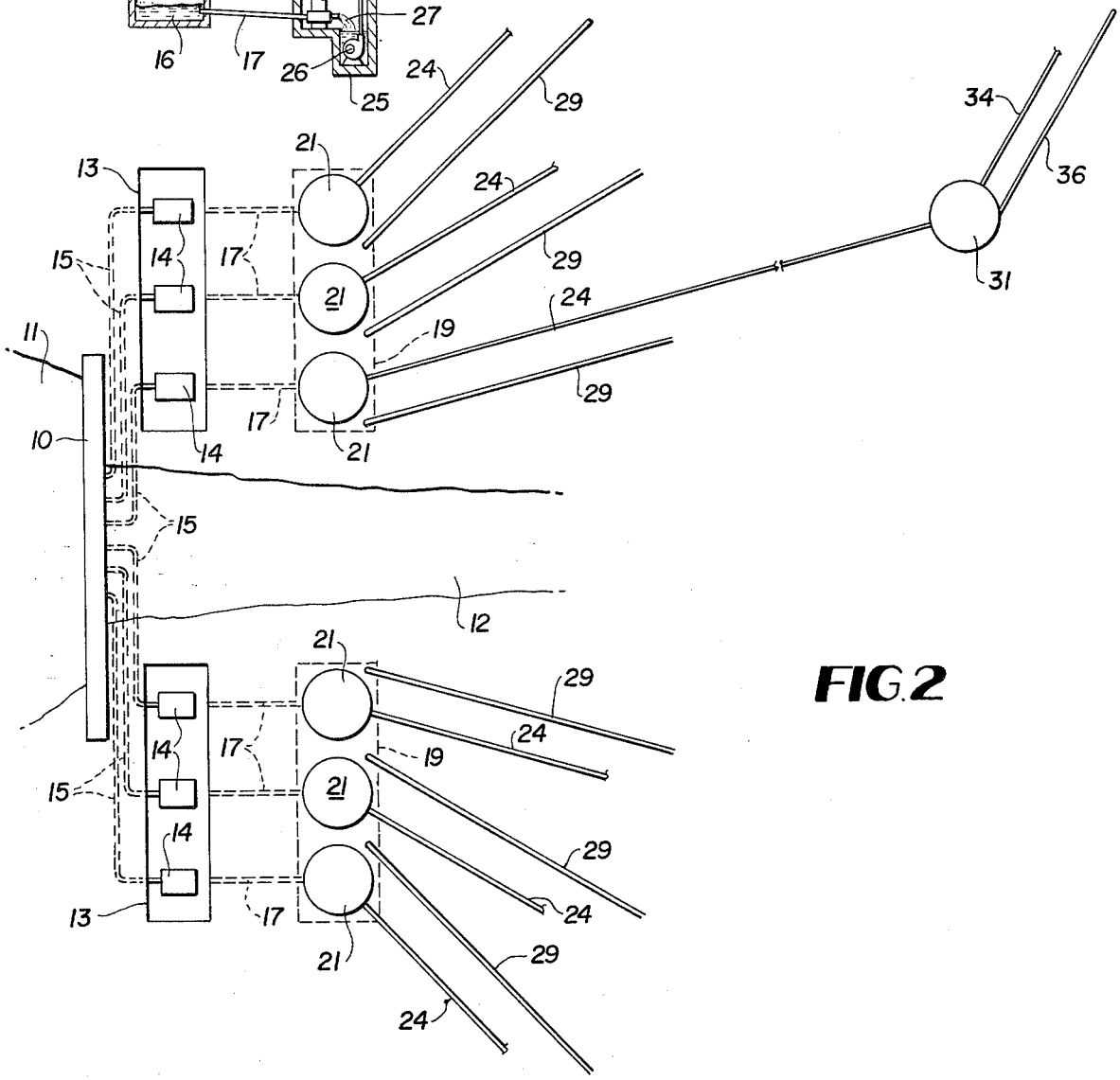
FIG.2

SELF-SUSTAINING LAND IRRIGATING AND HYDROELECTRIC POWER GENERATING SYSTEM

BACKGROUND OF THE INVENTION

The objective of this invention is to utilize the principle of operation set forth in U.S. Pat. No. 4,014,173 to create a practical, economical and self-sustaining irrigation system for vast arid regions which heretofore have been impossible to irrigate by conventional means. The irrigation system of the present invention can be utilized with or without the hydroelectric power generating feature of U.S. Pat. No. 4,014,173. The only requirement for complete viability of the irrigation system is one or more natural or man-made sources of water which are substantially inexhaustible.

A more specific object is to make use of hydraulic rams of the type disclosed in U.S. Pat. No. 4,014,173 for lifting water without utilizing external power into a series of tanks along the irrigation network to produce a system which may continue indefinitely for as long as the initial source of water exists.

A further object is to provide an irrigation system of the above type which is substantially independent of topography.

While the disclosed system is intended primarily as an irrigation system with or without power generation, it may also serve to supply water for other purposes along the system or network.

Still another object of the invention is to utilize the inherent simplicity, operational efficiency and comparative freedom from maintenance possessed by hydraulic rams which have been used for years in rural regions to fill water storage tanks from nearby streams but have not heretofore been known or used in irrigation systems.

Historically, ditches and aqueducts have been utilized for land irrigation over relatively short distances but have not been practical for irrigation on a long distance basis. Their success is dependent on water flow by gravity. Moreover, irrigation ditches and aqueducts share the common problem of requiring ducts of large initial water carrying capacities to amply supply the smaller downstream tributaries, thus drastically limiting their range. The present invention completely eliminates this problem in the prior art by providing an irrigation system which can be operated over vast areas while utilizing piping of uniform size throughout the entire system. Only distribution rate in this system has its controlled limits, these being pipe size and amount of water available at the source, coupled with the capacity of the rams used in the system. In extreme cases, it may take weeks or months to fill the system but, once filled, the self-sustaining system will supply water from the source to the farthest reaches at a uniform rate.

The heart of the irrigation system, the hydraulic ram, is a time tested piece of equipment which is able to operate continuously for many years, totally without requiring outside power. Hence, electrical power failure, shortages of gas and oil, have no effect on the operability of the irrigation system.

Other features and advantages of the invention will become apparent during the course of the following description.

BRIEF DESCRIPTION OF THE DRAWINGS

FIG. 1 is a partly schematic side elevational view of a power generating and irrigation system according to the invention.

FIG. 2 is a fragmentary partly schematic plan view of the same.

DETAILED DESCRIPTION

Figure 3:
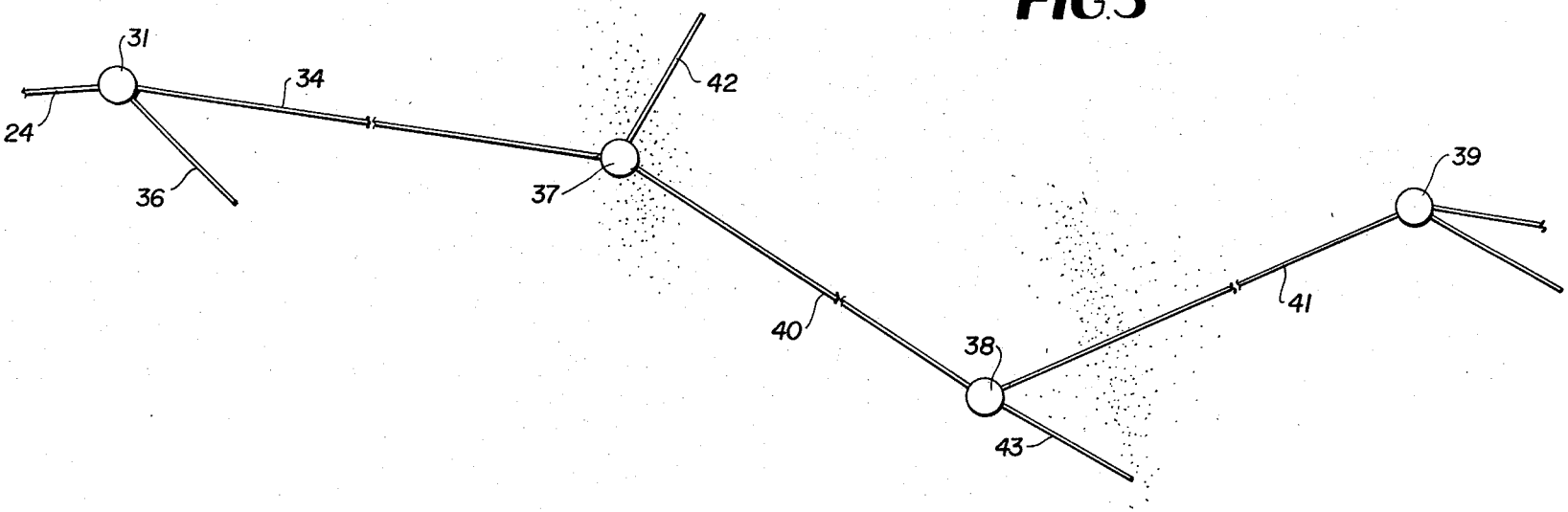
FIG. 3 is a fragmentary plan view of an irrigation branch.

Referring to the drawings in detail wherein like numerals designate like parts, a dam 10 contains headwaters 11, tailwaters 12 being shown downstream from the dam. The tailwaters 12 may follow the natural land contours. The headwaters 11 form the source of irrigation water for the entire system, as illustrated, it being understood that the source can also be a natural lake, river or other stream. Also, in some cases, the irrigation system may also embody additional downstream dams or other sources, not shown, for a more expanded system.

A generator well 13 or pit immediately downstream from the dam 10 contains near its bottom turbine generator means 14 in accordance with the teachings of U.S. Pat. No. 4,014,173. The turbine wheels of the generator means are fed water under full dam head pressure by conduits 15 connected in the bottom of dam 10. As fully explained in Patent 4,014,173, the arrangement of the generator means 14 in the pit 13 well below the base of the dam 10 effectively increases the head of the dam without increasing its height.

The turbine discharge waters 16 at the bottom of pit 13 are fed by gravity through sloping pipes 17 to the inlets of conventional hydraulic rams 18 mounted near the bottoms of somewhat downstream pits 19. In some cases, the pits 13 can be enlarged to accommodate the hydraulic rams 18 and the separate pits 19 can then be eliminated.

As explained in the referenced patent, the hydraulic rams 18 without the need for any external power will deliver the water supplied to them through riser pipes 20 into elevated tanks 21 downstream from the dam. Each elevated tank 21 is suitably supported at an appropriate elevation above ground level by leg means 22, as shown. Each tank has a descending overflow pipe 23 connected therein delivering water under effective tank head pressure through a downstream ram supply pipe 24 leading to and connected with the downstream hydraulic ram **18*a* preferably mounted at an elevation above ground level but well below the elevation of the tank 21. The effective water head between the tank 21 and hydraulic ram 18 is indicated at H in FIG. 1**.

Within a lower extension 25 of pit 19 is an externally powered lift pump 26 or sump pump for exhaust water 27 delivered by each hydraulic ram 18. Each pump 26 elevates this exhaust water through another riser pipe 28 to an above ground irrigation network pipe 29 which has outlets therein to irrigate the immediately adjacent ground.

Each downstream hydraulic ram **18*a* similarly elevates water delivered to it through the pipe 24 through a riser pipe 30 connected to an elevated tank 31 supported on leg means 32 and having a water overflow pipe 33 through which water under tank head pressure is delivered to a further downstream hydraulic ram supply pipe 34**.

The exhaust water of each downstream hydraulic ram 18*a* enters a receptacle 35 and is fed by gravity into a further irrigation pipe 36, ditch, or the like, forming a part of the irrigation network.

Figure 4:
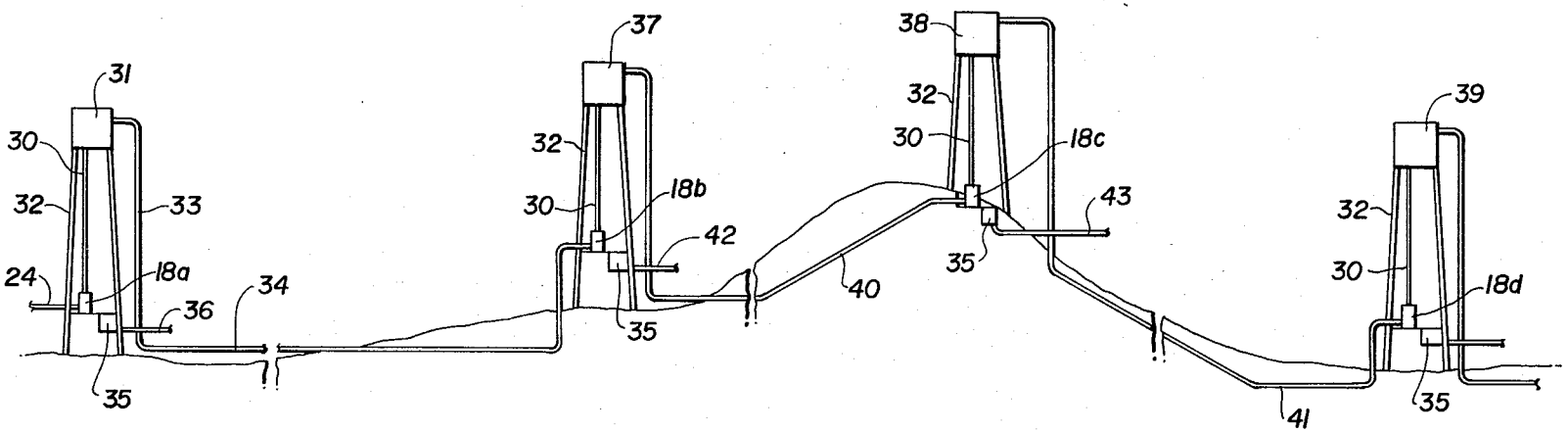
FIG. 4 is a side elevation of the irrigation branch shown in FIG. 3.

It can be seen in FIGS. 2, 3 and 4 that the system which is completely self-sustaining can be extended in diverse directions for indefinite distances, irrespective of ground contours and other terrain characteristics, thus enabling vast arid regions to be continuously and effectively irrigated, dependent only on the continued existance of the source 11. More particularly, FIG. 2 shows the downstream hydraulic ram supply pipes 24 and 34 extending in diverse directions. FIG. 3 and FIG. 4 show additional downstream elevated tanks 37, 38 and 39 whose supply pipes 40, 41, etc. and above-ground irrigation pipes 42, 43, etc. also extend in diverse directions dictated by local terrain. It may thus be understood that the irrigation system can be installed anywhere regardless of ground contours. The complete irrigation network may consist of any feasible number of network branches, such as the single branch shown in FIGS. 3 and 4, each such branch of the network containing any required number of elevated tanks and associated hydraulic rams 18*a*, 18*b*, 18*c*, 18*d*, etc., FIG. 4.

While the size of the irrigation network may vary widely, depending on local requirements, it is feasible to locate the tanks of each irrigation branch at intervals of one mile or more with a large number of tanks in each network branch. It can be appreciated that vast arid regions can be effectively irrigated by the invention. By tying into additional water sources downstream from the source 11 anywhere in one or more of the branches of the system, the system can be rendered even more efficient.

It should be further understood that, except for the sump pumps 26 at the first downstream irrigation station, the system is entirely self-sustained without need for further pumps or outside power to elevate the irrigation waters.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An irrigation system comprising at least one substantially inexhaustible water source, a first downstream hydraulic ram receiving water from said source under pressure due to an effective head between the source and said first hydraulic ram, a first elevated storage tank receiving water from said first hydraulic ram and having an overflow pipe, a first irrigation pipe near said first hydraulic ram and elevated tank, an externally powered pump delivering exhaust water from the first hydraulic ram to the first irrigation pipe, at least a second downstream hydraulic ram and second elevated storage tank receiving water from the second hydraulic ram and having an overflow pipe, a second irrigation pipe receiving water by gravity flow discharged by the second hydraulic ram, and a supply pipe for the second hydraulic ram connected therewith and connected with the first-named overflow pipe, there being an effective head between the water level in the first elevated storage tank and the inlet of the second downstream hydraulic ram.

2. An irrigation system as defined in claim 1, and said irrigation system comprising in each branch thereof a multiplicity of spaced downstream hydraulic rams and associated storage tanks and irrigation pipes with the irrigation pipes and supply pipes for the hydraulic rams connected between the rams and storage tanks extending in diverse directions.

3. An irrigation system as defined by claim 2, and the irrigation system comprising multiple irrigation branches extending in diverse directions from said water source and each branch of the system comprising said multiplicity of hydraulic rams, storage tanks and irrigation pipes and supply pipes for the hydraulic rams.

4. An irrigation system as defined by claim 1, and hydroelectric power generating means disposed between said source and said first downstream hydraulic ram, said first downstream hydraulic ram receiving by gravity flow exhaust water from the hydroelectric power generating means.

5. An irrigation system as defined by claim 4, and the hydroelectric power generating means and first downstream hydraulic ram disposed in subterranean pits near and downstream of said source with the bottoms of the pits at elevations well below the floor of said source.

6. An irrigation system as defined by claim 1, and the first downstream hydraulic ram being disposed in a subterranean pit downstream from said water source and with the bottom of said pit at an elevation well below the floor of said water source to increase the effective head thereof.

7. An irrigation system as defined by claim 1, and a storage receptacle for irrigation water discharged from the second hydraulic ram and being connected with the second irrigation pipe to deliver water thereto by gravity flow.

8. An irrigation system as defined by claim 1, and said source including a dam and headwaters behind the dam, and water delivery means coupled between the base of the dam and the inlet of the first hydraulic ram.

9. An irrigation system as defined by claim 5, and said power generating means and first downstream hydraulic ram being in multiple units in said pits.

10. An irrigation system as defined by claim 4, and the hydroelectric power generating means comprising at least one water turbine driven generator.

* * * * *